United States Patent [19]

Whitaker, Jr.

[11] Patent Number: 4,882,860

[45] Date of Patent: Nov. 28, 1989

[54] APPARATUS FOR REMOVING BALLAST FROM BENEATH RAILROAD TRACKS

[75] Inventor: John B. Whitaker, Jr., Wetumpka, Ala.

[73] Assignee: Kershaw Manufacturing Company, Inc., Montgomery, Ala.

[21] Appl. No.: 242,555

[22] Filed: Sep. 12, 1988

[51] Int. Cl.[4] ..... E01B 27/04

[52] U.S. Cl. ..... 37/191 A; 37/104; 299/63; 198/526; 198/716

[58] Field of Search ..... 37/104, 191 A, 2 R; 171/16; 104/2; 198/520, 716; 299/63, 82

[56] References Cited

U.S. PATENT DOCUMENTS

| | | | |
|---|---|---|---|
| 2,594,990 | 4/1952 | Proteller | 37/191 A |
| 2,737,901 | 3/1956 | Drouard et al. | 37/104 X |
| 2,755,077 | 7/1956 | Proctor | 299/82 X |
| 2,778,128 | 1/1957 | Drouard et al. | 37/104 |
| 3,436,848 | 4/1969 | Peppin et al. | 37/104 |

*Primary Examiner*—Dennis L. Taylor
*Assistant Examiner*—J. Russell McBee
*Attorney, Agent, or Firm*—Jennings, Carter, Thompson & Veal

[57] ABSTRACT

A railroad undercutter economizes both weight and space requirements through the use of a single continuous chain which carries ballast from beneath a railroad track to a track supported conveyor with the chain entering beneath and exiting from beneath the track on the same side and turning through a vertical arc of approximately 130° to move above the track.

12 Claims, 4 Drawing Sheets

77
53
76
58
63
62'
62
4
4
43
42
51
52
47
46
45
44
48
39
61
37
33
29
14
32
31
24
18
34
56
28
14
36
41
38
36
26
27

APPARATUS FOR REMOVING BALLAST FROM BENEATH RAILROAD TRACKS

FIELD OF THE INVENTION

The present invention relates to railroad track maintenance and the equipment used therefor. More particularly, the present invention relates to the type of equipment known as undercutters which remove ballast from the track while the track remains substantially in place. In even greater particularity the present invention relates to such undercutters which use a continuous loop chain element.

BACKGROUND OF THE INVENTION

Numerous undercutters have been developed by the engineers of the assignee of this application and by others, each stage of undercutter development has brought improvement in speed and efficiency and has often enhanced the general purpose utility of the undercutter art. Nonetheless certain sections of track have remained inaccessible to known undercutter technology. Undercutters are often used in conjunction with large ditcher wheels which dig a trench alongside the track to permit the undercutter to reach under the track Other undercutters utilize a continuous chain which forms a loop extending beneath the track with an entry on one side and an exit on the other side of the track and continuing above the carriage upon which the drive mechanism is supported. Still other undercutters employ dual sided undercutter members, each of which remove a portion of the ballast to each side of the track. While each of these various types of undercutters are suitable for some tracks, they are unsuited for the particular track environment for which the present invention is designed. In metropolitan areas and in Europe, a great deal of commuter railroad track is located underground. Oftentimes the clearance both laterally and horizontally alongside such tracks is insufficient to permit the use of ditcher wheels or apparatus which must have access to ballast on both sides of the track. Accordingly, neither the continuous loop nor dual sided undercutters can be employed to remove ballast beneath these tracks. A similar problem exists at railroad switches where two sets of track merge or diverge. In this instance, neither the dual sided nor continuous loop undercutter can conveniently be employed.

SUMMARY OF THE INVENTION

It is the principal object of the present invention to facilitate the removal of ballast from beneath railroad tracks in environments where only one side of the track is accessible to the undercutter and where such access is further limited either horizontally or vertically as is the case in an underground railway.

Yet another object of the invention is to reduce the complexity and size of undercutting equipment in general by eliminating the large ditcher wheel employed in the prior art.

These and other objects and advantages of my invention are enabled through a novel chain support structure which allows the chain to enter and exit beneath the track on the same side thereof and to lift ballast removed therefrom above the track to a discharge point. That is to say, contrary to the prior art wherein undercutter chains were constrained to move substantially within a single plane, my undercutter chain is configured to move along a path that lies in two intersecting planes: one beneath the track and a second inclined so as to extend above the track, with the planes intersecting alongside the track.

BRIEF DESCRIPTION OF THE DRAWINGS

Apparatus embodying features of my invention ar depicted in the accompanying drawings which form a portion of this disclosure and wherein.

DESCRIPTION OF THE PREFERRED EMBODIMENT

Figure 1:
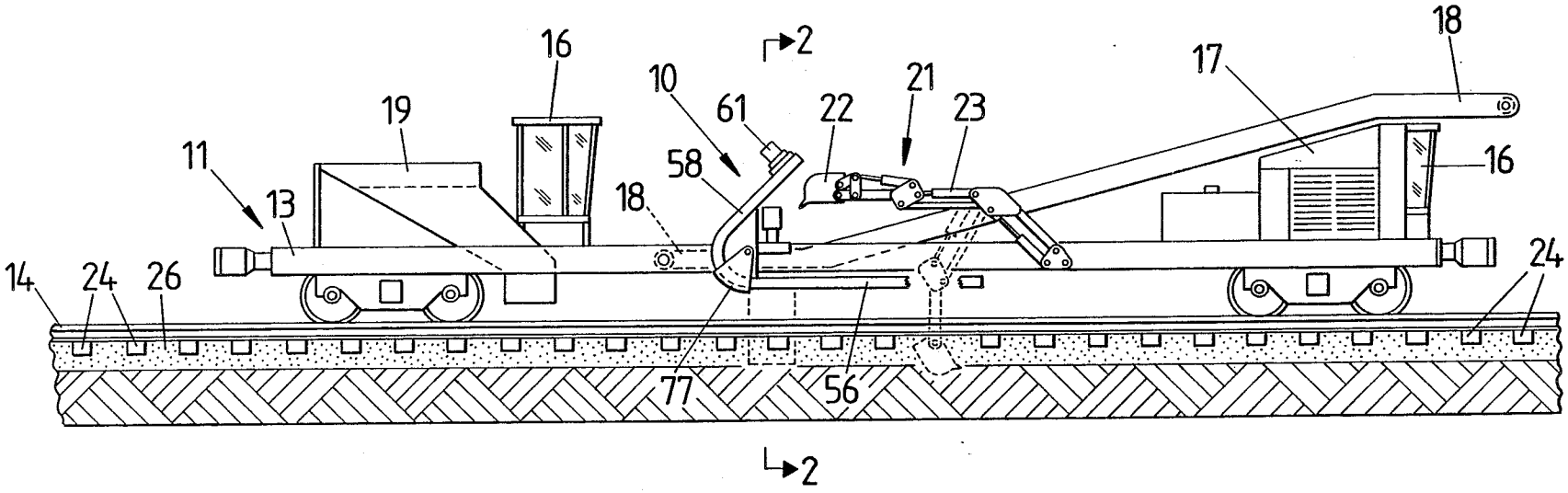
FIG. 1 is a side elevational view of a railroad track maintenance apparatus which incorporates my undercutter.

Referring to the accompanying drawings for a clearer understanding of the present invention, it should be noted in FIG. 1 that my undercutter apparatus 10 is really a component on a railroad maintenance apparatus 11 including a wheeled carriage 13 supported on a track 14. The carriage 13 may be provided with one or more operator stations 16, a motor or power supply 17 for driving the undercutter apparatus and a ballast removal conveyor 18. A dispersal chute 19 for returning ballast to the track ]4 may also be provided. Additionally, as shown in FIG. 1, a trencher 21 is provided to prepare the ballast for the undercutter apparatus 10, In FIG. 1 the undercutter apparatus 10 is shown in its travel position rather than in its work position. The trencher 21 used in this embodiment is a scoop 22 mounted on a hydraulically activated articulated arm 23.

Figure 2:
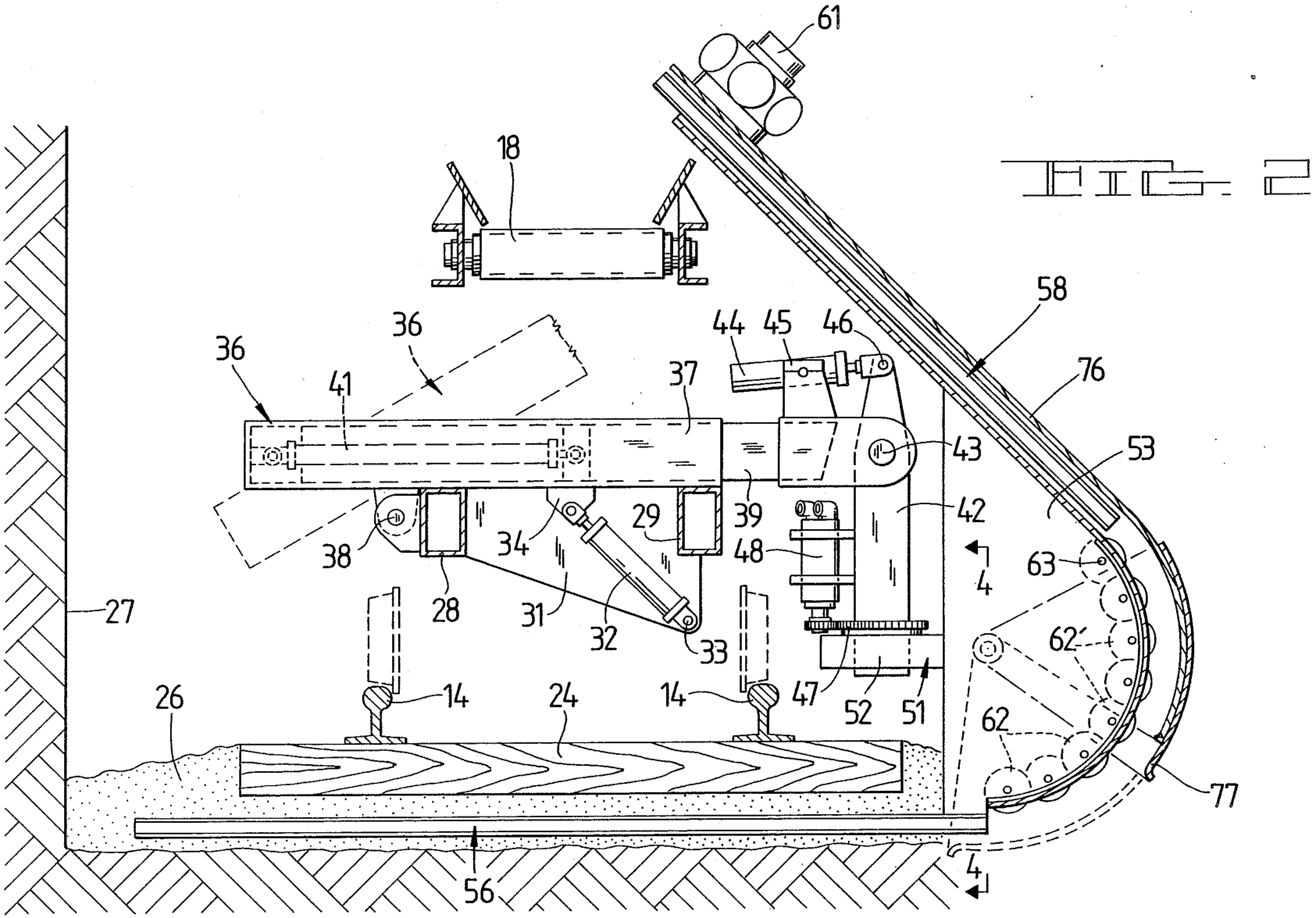
FIG. 2 is a sectional view take along line 2—2 of FIG. 1 showing my undercutter its work position.
Figure 5:
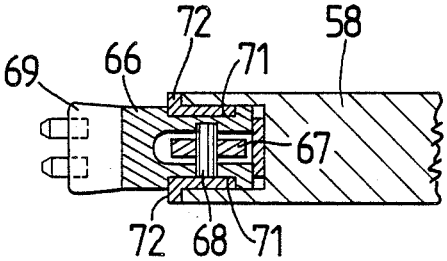
FIG. 5 is a partial sectional view of one edge of the inclined guide bar.
Figure 6:
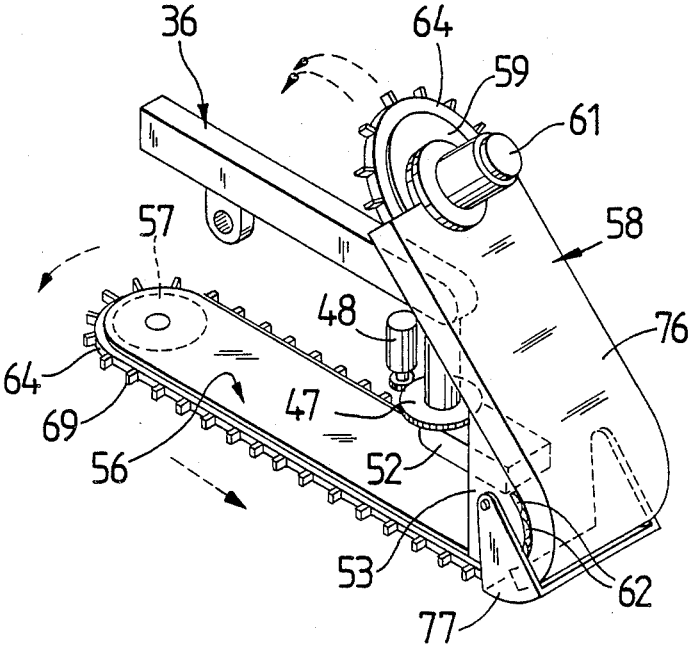
FIGS. 6 & 7 are partial perspective views of the undercutter with the supporting carriage omitted for clarity.
Figure 7:
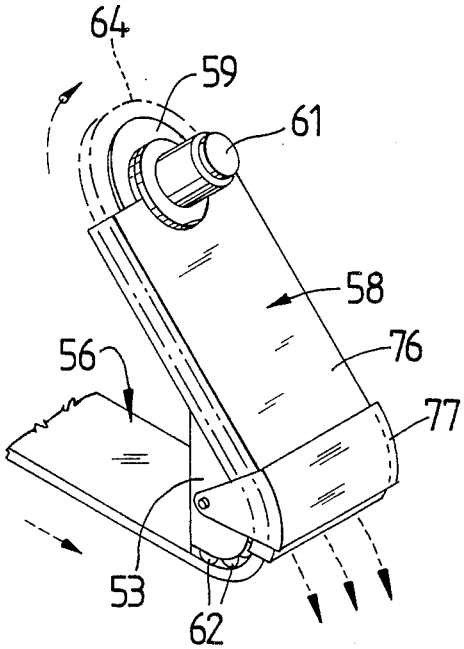

The undercutter apparatus 10 in its operative mode is more clearly shown in FIGS. 2, 5 & 6. In FIG. 2, the track 14 rests on crossties 24 which in turn are supported by the ballast of the track bed 26 Adjacent the track is a wall 27 which limits access to the track. The carriage 13 is defined by a set of longitudinal frame members 28 and 29. A plate 31 is mounted between the frame members and serves to anchor the lower end of a hydraulic cylinder 32 at a pivotal connection 33. The other end of the cylinder 32 is connected to an eye 34 formed on an extendable boom assembly 36 which includes a sleeve 37 mounted for vertical pivotal motion about a pin and clevis connection 38 to frame member 28 and a slider 39 telescopically mounted within the sleeve 37. A hydraulic actuator 41 within the sleeve 37 positions the slider 39 relative to the sleeve 37. A column 42 is pivotally mounted for movement about a horizontal axis 43 located in the outer end of slider 39. An alignment cylinder 44 is carried in a bracket 45 supported on slider 39 and is connected to the upper end of the column 42, as with a clevis 46 or the like. Supported on the column 42 at the lower end thereof is a ring gear 47 and hydraulic motor 48 for driving the same. The ring gear 48 is affixed to an undercutter frame 51, which includes a support arm 52 and a curvilinear portion 53, such that rotation of the ring gear 47 rotates the undercutter frame 51 about the vertical axis of the column 42.

The undercutter frame 51 supports and connects three distinct portions of the undercutter assembly 10. The first portion is an undercutter guide bar 56 which lies in a generally horizontal plane in both the travel and work position. Undercutter guide bar 56 has a terminal sprocket 57 mounted at one end thereof and is of sufficient length to span the entire width of the track. The second portion is an inclined guide bar 58 which lies in a plane intersecting the plane of undercutter guide bar 56 and forming an acute angle therebetween of about 50°. A drive sprocket 59 and motor 61 are located at the upper end of inclined guide bar 58. The third portion is intermediate the undercutter guide bar 56 and the inclined guide bar and comprises a plurality of guide rollers 62 which are supported for rotation on horizontal axles 63 mounted about the arcuate portion of curvilinear frame member 53. Each guide roller 62 is in the form of a disc and each roller 62 is staggered relative to its adjacent roller 62' such that the rollers rotate in parallel vertical planes. In the embodiment depicted, eight rollers 62 are used on each side of frame member 53 and with axles 63 spaced about the arc thereof at about 16° separation from each other.

Figure 3:
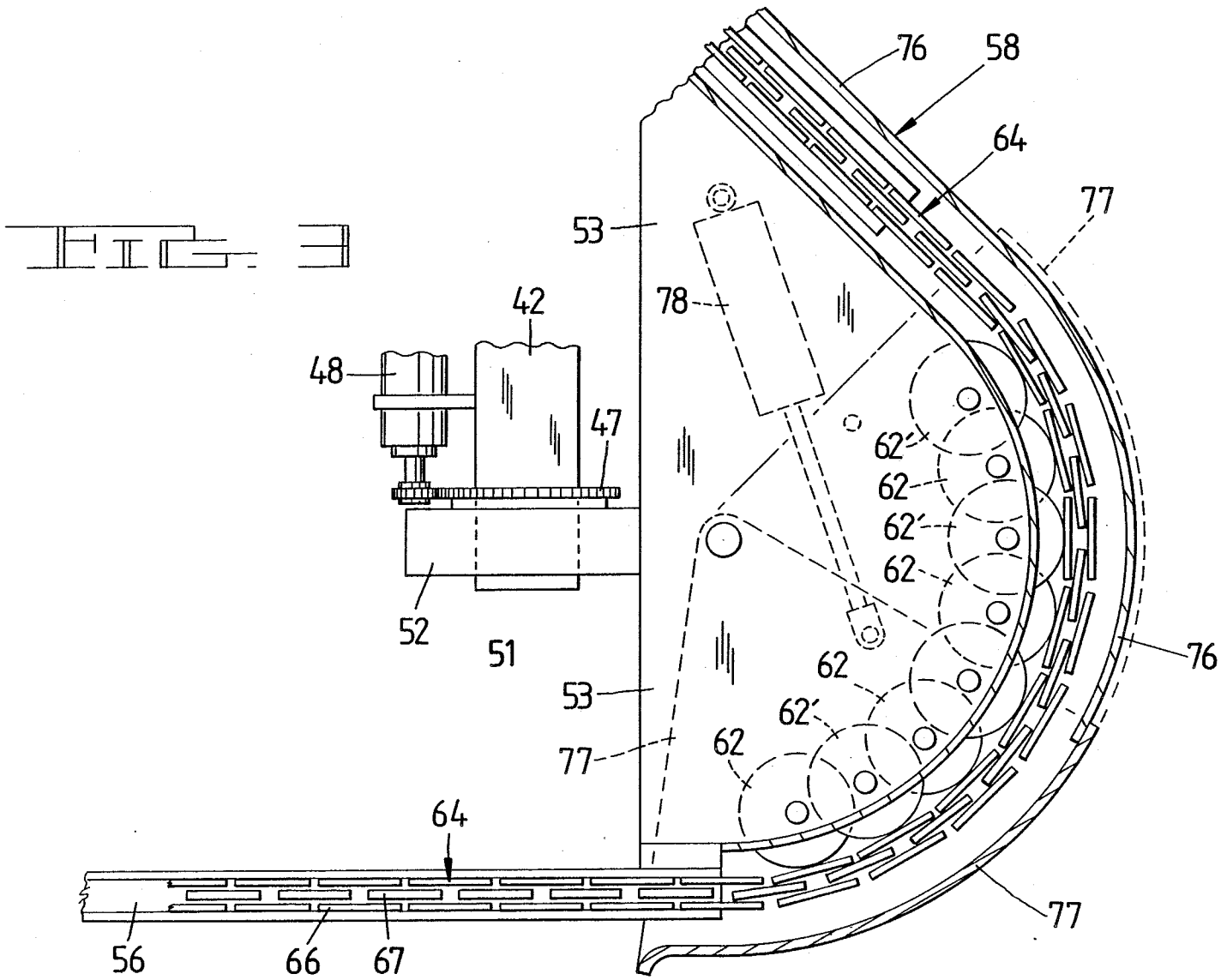
FIG. 3 is a detail view of the curvilinear portion of the chain guide.
Figure 4:
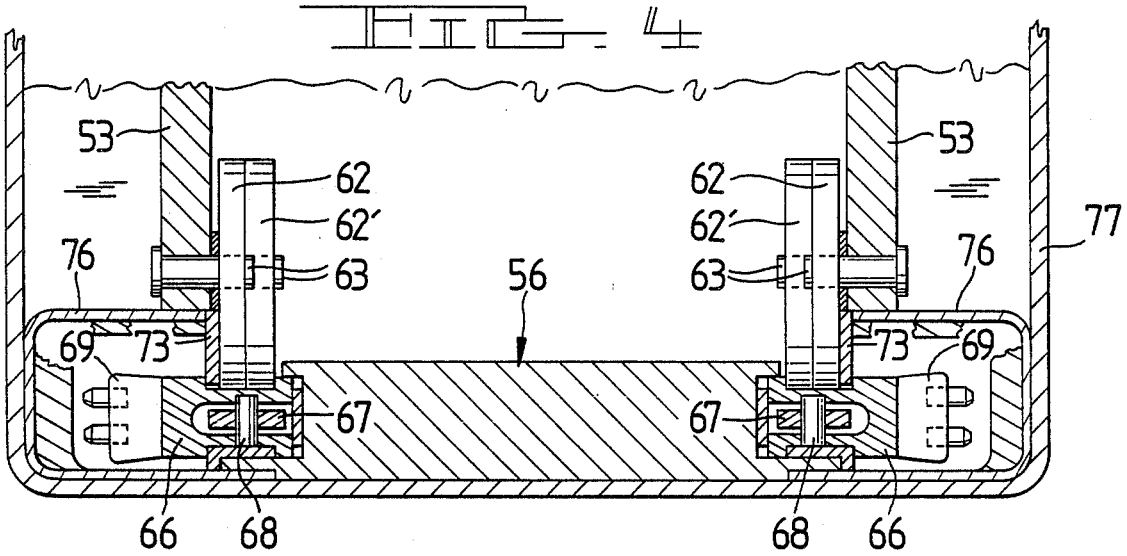
FIG. 4 is a partial sectional view along line 4—4 of FIG. 2.

A chain 64 forms a closed loop about the undercutter guide bar 56, the rollers 62, and the inclined guide bar 58 and is driven by the drive sprocket 59. With reference to FIGS 3, 4 & 5, the chain 64 has a plurality of main links 66 connected by intermediate links 67 and pins 68. Each main link carries a work piece 69 for digging into the ballast and urging the ballast in the direction of travel of the chain 64. A guide channel 71 is formed on each side of the main link 66 and receives therein a wear member 72 carried by the guide bars 56 and 58. The guide channel also receives the rollers 62 and a lateral guide plate 73 as the chain traverses the curvilinear frame member 53 as shown in FIGS. 3 & 4. From the foregoing it may be seen that the chain 64 is sufficiently flexible to pass around the 180° sprockets 57 and 59 and to undergo the 130° deflection about the roller 62.

It should be noted in FIGS. 2, 3, 6 & 7 that a housing 76 is spaced from and encloses the chain 64 over a portion of the inclined guide bar 58 such that a conduit is formed through which ballast can be urged upwardly for eventual discharge on to discharge conveyor 18. In as much as railroad beds have varying ballast profiles, a movable chute 77 whose position is controlled by cylinder 78 is provided such that the conduit formed by housing 76 may be extended in accordance with the ballast profile. Alternatively the chute 77 may be retracted as in FIG. 7 to permit discharge of the ballast alongside the track.

In accordance with the foregoing description, my apparatus is operated as follows. The maintenance equipment 11 is moved along the track 14 to a point at which ballast removal is required. The trencher 21 is used to excavate ballast alongside the track as necessary to allow the undercutter guide bar 56 to be positioned at its cutting level alongside the track. Positioning of the undercutter guide bar 56 in the trench is accomplished using the cylinders 32, 37 and 43 to manipulate the boom 36, slider 39 and column 42. When the undercutter guide bar 56 is positioned at the proper height and parallel to the track, the motor 61 begins driving the chain 64 about its circuit. Motor 48 then turns the ring gear 47 to pivot the undercutter assembly 10 such that the undercutter guide bar 56 makes its way beneath the track. When the undercutter guide bar 56 is perpendicular to the track, chute 77 is positioned to direct ballast excavated by chain 64 into housing 76 and upward to the discharge conveyor 18. It should be noted that the chain's path about the periphery of the undercutter includes an entrant portion which is a first peripheral portion alongside the undercutter guide bar 56, a return portion or second peripheral portion along the opposite side of the undercutter guide bar 56 along which ballast is removed to one side of the track, a first curvilinear third peripheral portion about roller 62, an upwardly inclined fourth peripheral portion along one side of the inclined guide bar 58 along which ballast is removed to conveyor 18, a fifth peripheral portion along the opposite side of guide bar 58 and a second curvilinear sixth peripheral portion about roller 62 which terminates at the entrant portion.

While I have shown my invention in one form, it will be obvious to those skilled in the art that it is not so limited but is susceptible of various changes and modifications without departing from the spirit thereof.

What I claim is:

1. Apparatus for removing ballast from beneath a railroad track wherein the apparatus is supported on said railroad track on a rail mounted carriage, the apparatus comprising:

(a) a continuous chain undercutter having a first portion with first and second coplanar and parallel sides disposed horizontally, a second portion with parallel and coplanar sides disposed at an acute angle relative to said first portion and an intermediate portion formed at the intersection of said first and second portions and a chain extending from said intermediate portion horizontally along said first coplanar side of said first portion about the end thereof and along the said second coplanar side of said first portion to said intermediate portion where said chain turns upwardly and extends along one side of said second portion, about the upper end thereof and downwardly along the opposite side of said second portion to the intermediate portion;

(b) drive means for imparting motion in said chain;

(c) means for pivoting said continuous chain undercutter selectively to a position wherein said first portion is parallel to said track and a position wherein said first portion is perpendicular to said track; and (d) lift means for raising and lowering said continuous undercutter relative to said track.

2. Apparatus as defined in claim 1 further comprising guide means spaced from said intermediate portion for guiding ballast from said first portion to said second portion.

3. Apparatus as defined in claim 1 wherein said first portion has a length greater than the width of said track whereby ballast beneath said track can be removed to one side thereof.

4. Apparatus as defined in claim 1 wherein said intermediate portion comprises:

(a) a curvilinear frame disposed within the angle formed by said first and second portions;

(b) a plurality of disc-like rollers mounted in overlapping relation to each other on either side of said curvilinear frame for rotation about horizontal-axes spaced along said curvilinear frame such that said chain is supported on said rollers intermediate said first and second portions.

5. Apparatus as defined in claim 4 further comprising guide means spaced from said intermediate portion for guiding ballast from said first portion to said second portion.

6. Apparatus supported on a track mounted carriage for removing ballast from beneath a railroad track comprising a continuous chain undercutter including a chain mounted for circuitous movement along the periphery of said undercutter such that said chain is constrained to move along a first peripheral portion extending beneath said railroad track from a first side thereof to an opposite side thereof, thence along a second peripheral portion beneath said railroad track from said opposite side to said first side, thence along a curvilinear third peripheral portion upwardly about the first side of said track, thence along a fourth peripheral portion inclined at an acute angle relative to said second peripheral portion and extending above said track mounted carriage; thence along a fifth peripheral portion parallel to and co-planar with said fourth peripheral portion, thence along a curvilinear sixth peripheral portion parallel to said curvilinear third peripheral portion to said first peripheral portion, whereby ballast is removed from beneath said track by said chain as it moves along said peripheral portions; and conveying means mounted atop said carriage for receiving and conveying ballast from said continuous chain undercutter proximal said fourth peripheral portion.

7. Apparatus as defined in claim 6 further comprising lift means for moving said continuous chain undercutter vertically adjacent said first side of said track and means for pivoting said continuous chain undercutter about a vertical axis such that said first peripheral portion is selectively movable to a position parallel to said track and a position perpendicular to said track.

8. Apparatus as defined in claim 7 wherein said third peripheral portion and said sixth peripheral portion comprise:

(a) a curvilinear frame connecting said first and fifth and said second and fourth peripheral portions;

(b) a plurality of disc-like rollers mounted in overlapping relation to each other on either side of said curvilinear frame for independent rotation about horizontal axes spaced along said curvilinear frame such that said chain is supported on said rollers along said third and sixth peripheral portions.

9. Apparatus as defined in claim 7 wherein said lift means comprises an extendable boom pivotally mounted to said carriage for movement about a horizontal axis on the side of said carriage opposite said first side of said track and means for moving said extendable boom about said axis.

10. Apparatus as defined in claim 6 wherein said third peripheral portion and said sixth peripheral portion comprise:

(a) a curvilinear frame connecting said first and fifth and said second and fourth peripheral portions;

(b) a plurality of disc-like rollers mounted in overlapping each other on either side of said curvilinear frame for independent rotation about horizontal axes spaced along said curvilinear frame such that said chain is supported on said rollers along said third and sixth peripheral portions.

11. Apparatus as defined in claim 10 further comprising guide means spaced from said curvilinear third peripheral portion for directing ballast carried by said chain along the curvilinear path of said third peripheral portion with said guide means being selectively movable about a horizontal axis to a position distal said curvilinear third peripheral portion such that said ballast is discharged laterally therefrom.

12. Apparatus as defined in claim 10 wherein said continuous chain undercutter further comprises a housing spaced from said chain along selected peripheral portions for confining ballast carried by said chain, thereby providing a conduit through which said ballast is urged by said chain.

* * * * *